US007368742B2

(12) United States Patent
Hergenhan et al.

(10) Patent No.: US 7,368,742 B2
(45) Date of Patent: May 6, 2008

(54) ARRANGEMENT AND METHOD FOR METERING TARGET MATERIAL FOR THE GENERATION OF SHORT-WAVELENGTH ELECTROMAGNETIC RADIATION

(75) Inventors: Guido Hergenhan, Jena (DE); Diethard Kloepfel, Kleinhelmsdorf (DE)

(73) Assignee: XTREME technologies GmbH, Jena (DE)

( * ) Notice: Subject to any disclaimer, the term of this patent is extended or adjusted under 35 U.S.C. 154(b) by 308 days.

(21) Appl. No.: 11/182,362

(22) Filed: Jul. 15, 2005

(65) Prior Publication Data

US 2006/0017026 A1 Jan. 26, 2006

(30) Foreign Application Priority Data

Jul. 23, 2004 (DE) ..... 10 2004 036 441

(51) Int. Cl.
*H05G 2/00* (2006.01)

(52) U.S. Cl. ..... 250/504 R; 250/492.2; 250/493.1; 378/119; 378/143

(58) Field of Classification Search ..... 250/504 R, 250/492.2, 493.1; 378/119, 143
See application file for complete search history.

(56) References Cited

U.S. PATENT DOCUMENTS 4,723,262 A * 2/1988 Noda et al. ..... 378/119
5,577,092 A 11/1996 Kublak et al.
6,324,256 B1 11/2001 McGregor et al.

(Continued)

FOREIGN PATENT DOCUMENTS

DE 102 60 376 7/2004

(Continued)

OTHER PUBLICATIONS

Proceedings of SPIE, vol. 4688 (2002) pp. 619-625 "Laser Plasma Radiation Sources based on a Laser-Irradiated Gas Puff Target for X-Ray and EUV Lithography Technologies" Henryk Fiedorowiez, et al.

*Primary Examiner*—Jack I. Berman
*Assistant Examiner*—Michael J Logie
(74) *Attorney, Agent, or Firm*—Reed Smith LLP

(57) ABSTRACT

The invention is directed to an arrangement for metering target material for the generation of short-wavelength electromagnetic radiation from an energy beam induced plasma, in particular X radiation and EUV radiation. The object of the invention is to find a novel possibility for metering target material for the generation of short-wavelength electromagnetic radiation from an energy beam induced plasma which makes it possible to provide reproducibly supplied mass-limited targets in such a way that only the amount of target material for plasma generation that can be effectively converted to radiating plasma in the desired wavelength region arrives in the interaction chamber and, therefore, debris generation and the gas burden in the interaction chamber are minimized. This object is met, according to the invention, in that an injection device is provided for target generation, wherein means are arranged upstream of the nozzle in a nozzle chamber for a defined, temporary pressure increase in order to introduce an individual target into the interaction chamber exclusively when required, and an antechamber is arranged around the nozzle for generating a quasistatic pressure upstream of the interaction chamber, wherein an equilibrium pressure in the antechamber prevents the escape of target material as long as there is no pressure increase in the nozzle chamber.

33 Claims, 8 Drawing Sheets

U.S. PATENT DOCUMENTS

| | | | | |
|---|---|---|---|---|
| 6,855,943 | B2 * | 2/2005 | Shields | 250/504 R |
| 6,864,497 | B2 * | 3/2005 | Orsini et al. | 250/504 R |
| 6,882,704 | B2 * | 4/2005 | Schriever et al. | 378/119 |
| 7,122,814 | B2 * | 10/2006 | Hergenhan et al. | 250/504 R |
| 7,250,621 | B2 * | 7/2007 | Gaebel et al. | 250/504 R |
| 2003/0223546 | A1 | 12/2003 | McGregor et al. | |
| 2004/0105095 | A1 * | 6/2004 | Stobrawa et al. | 356/318 |
| 2004/0129896 | A1 * | 7/2004 | Schmidt et al. | 250/492.2 |
| 2004/0159802 | A1 * | 8/2004 | Ziener et al. | 250/504 R |

FOREIGN PATENT DOCUMENTS

| | | |
|---|---|---|
| DE | 103 06 668 | 8/2004 |
| EP | 0 186 491 | 6/1992 |
| EP | 0 895 706 | 6/2003 |
| WO | WO 01/30122 | 4/2001 |

* cited by examiner

ARRANGEMENT AND METHOD FOR METERING TARGET MATERIAL FOR THE GENERATION OF SHORT-WAVELENGTH ELECTROMAGNETIC RADIATION

CROSS-REFERENCE TO RELATED APPLICATIONS

This application claims priority of German Application No. 10 2004 036 441.9, filed Jul. 23, 2004, the complete disclosure of which is hereby incorporated by reference.

BACKGROUND OF THE INVENTION a) Field of the Invention

The invention is directed to an arrangement and a method for metering target material for the generation of short-wavelength electromagnetic radiation from an energy beam induced plasma. It is applied in particular in EUV radiation sources for projection lithography in semiconductor chip fabrication.

b) Description to the Related Art

Reproducible mass-limited targets for pulsed energy input for plasma generation have gained acceptance, above all in radiation sources for projection lithography, because they minimize unwanted particle emission (debris) compared to other types of targets. An ideal mass-limited target is characterized in that the particle number in the focus of the energy beam is limited to the particles used for generating radiation.

Excess target material that is vaporized or sublimated or which, although ionized, is not excited by the energy beam to a sufficient degree for the desired radiation emission (marginal area or immediate surroundings of the interaction point) causes not only increased emission of debris but also an unwanted gas atmosphere in the interaction chamber which in turn contributes considerably to an absorption of the short-wavelength EUV radiation generated from the plasma.

There are a number of embodiment forms of mass-limited targets known from the prior art. These are listed in the following along with their characteristic disadvantages:

- Continuous liquid jet, possibly also frozen (solid consistency) (EP 0 895 706 B1)
  - Mass limiting can be realized only to a limited extent because of the large size of the target in one linear dimension, resulting in increased debris and an unwanted gas burden in the vacuum chamber.
  - The shock wave proceeding from the plasma expansion (with slight damping) in the target jet in the direction of the target nozzle leads to a certain destruction of the target flow and, therefore, to a limiting of the pulse repetition rate of the laser excitation.
- Clusters (U.S. Pat. No. 5,577,092), gas puffs (Fiedorowicz et al., SPIE Proceedings, Vol. 4688, 619) and aerosols (WO 01/30122 A1; U.S. Pat. No. 6,324,256 B1)
  - lead to severe nozzle erosion with short distances between the interaction point and the target nozzle and, at large distances from the nozzle (due to dramatically decreasing average density of the target), to a low efficiency of the radiation emission of the plasma.
- Continuous flow of individual droplets (EP 0 186 491 B1)
  - requires precise synchronization with the excitation laser,
  - cold target material in the vicinity of the plasma (less than with the target jet, but still present) is vaporized and leads to absorbent gas atmosphere and increased debris.

All of the so-called mass-limited targets mentioned above have in common that there is more target material in the interaction chamber than is needed for generating the emitting plasma in spite of limiting the diameter of the target flow. With a continuous flow of droplets, for example, only about every hundredth drop is struck by the laser pulse. Apart from increased generation of debris, this leads to excess target material in the interaction chamber which causes an increased gas burden (particularly when xenon is used as target) and, therefore, an increased pressure in the interaction chamber. The increased gas burden leads in turn to an unwanted increase in the absorption of radiation emitted by the plasma. Further, the unused target material leads to increased material consumption and accordingly raises costs unnecessarily.

OBJECT AND SUMMARY OF THE INVENTION

It is the object of the invention to find a novel possibility for metering target material for the generation of short-wavelength electromagnetic radiation, in particular X radiation and EUV radiation, from an energy beam induced plasma which makes it possible to provide reproducibly supplied mass-limited targets in such a way that only the amount of target material for plasma generation that can be effectively converted to radiating plasma in the desired wavelength region arrives in the interaction chamber and, therefore, debris generation and the gas burden in the interaction chamber are minimized.

In an arrangement for metering target material for the generation of short-wavelength electromagnetic radiation, in particular EUV radiation, in which a target generator is arranged for providing target material along a given target path and an energy beam for generating a radiation emitting plasma is directed to the target path, the above-stated object is met, according to the invention, in that the target generator has an injection device which contains a nozzle chamber with nozzle and which is connected with a reservoir, wherein means are provided at the nozzle chamber for a defined, temporary pressure increase in order to introduce an individual target into the interaction chamber at the interaction point exclusively when required for the generation of plasma, and in that means are arranged for adjusting an equilibrium pressure in the nozzle in order to compensate for a pressure drop at the nozzle of the injection device resulting from the pressure difference between the vacuum pressure in the interaction chamber and the pressure exerted on the target material in the reservoir, wherein the adjusted equilibrium pressure prevents the escape of target material as long as there is no temporary pressure increase in the nozzle chamber.

A piezo element is advantageously provided as means for the pressure increase in the nozzle chamber. The piezo element causes a reduction in the volume of the nozzle chamber by means of inward displacement of a wall of the nozzle chamber. For this purpose, the nozzle chamber preferably has a membrane wall which is pressed into the interior of the nozzle chamber when voltage is applied to the piezo element. However, a piezo stack can also advisably be arranged inside the nozzle chamber for reducing the volume of the chamber.

In another advantageous variant, a constriction is provided in the nozzle chamber and a heating element is arranged around this constriction, wherein the target material is heated inside the constriction and a defined target volume is thrust into the nozzle chamber as a result of thermal expansion and leads to the temporary pressure increase. A portion of a connection line to the reservoir close to the nozzle chamber can also advisably be used as a constriction of the nozzle chamber.

Additional pressure is advantageously applied in the reservoir for liquefaction for a target material that is liquid at the process temperature only at pressures above 50 mbar. A target material that can be used for this embodiment variant is preferably xenon.

With a target material that is liquid at the process temperature at pressures of less than 50 mbar, the gravitational pressure of the target material in the reservoir can advisably be used for adjusting pressure. Target materials using tin are preferably used for this purpose. Various tin alloys and tin chlorides have proven particularly suitable for the generation of EUV radiation. Tin(IV) chloride ($SnCl_4$), which is already in liquid form under process conditions for plasma generation, and tin-II-chloride ($SnCl_2$) are suitable as preferred target material when used in aqueous or alcoholic solution.

When using this kind of target material which is liquid at pressures below 50 mbar under process conditions for plasma generation, the hydrostatic or gravitational pressure of the target material can be used to minimize the equilibrium pressure at the outlet of the nozzle. For reducing pressure, a height difference between the liquid level of the target material at the nozzle and in the reservoir must be adjusted in such a way that the liquid level in the reservoir lies below the outlet of the nozzle in the direction of the force of gravity. For this purpose, the nozzle of the nozzle chamber can advisably be arranged in direction of the force of gravity so that the individual targets are subject to the acceleration due to gravity along the target path. On the other hand, it can be advantageous for the desired reduction of the pressure drop in the target nozzle when the nozzle is arranged at the nozzle chamber opposite to the direction of the force of gravity.

The means for generating an equilibrium pressure are preferably realized in that an antechamber having an opening along the target path for the exit of the individual targets is arranged around the nozzle of the injection device in front of the interaction chamber, wherein a quasistatic pressure is present in the antechamber which, as equilibrium pressure, prevents target material from escaping as long as there is no temporary pressure increase in the nozzle chamber.

A buffer gas is preferably fed to the antechamber as a moderator for high kinetic energy particles from the plasma. The buffer gas supplied to the antechamber can be an inert gas or a noble gas. Nitrogen, helium, neon, argon and/or krypton are preferably used.

The energy beam required for introducing energy into the individual target according to the invention is preferably a focused laser beam. A pulse of the energy beam in the interaction chamber is advisably synchronized with the ejection of exactly one individual target.

However, it has proven advantageous particularly when using a laser beam as energy beam that a pulse of the energy beam in the interaction chamber is synchronized with the ejection of at least two individual targets from the nozzle of the injection device, wherein at least a first target is a sacrifice target for generating a vapor screen for at least one main target to be struck by the energy beam.

In a first modified construction variant, a pulse of the energy beam in the interaction chamber is synchronized with the ejection of at least two individual targets from a plurality of nozzles of the injection device, wherein the nozzles are arranged in at least one plane that forms an angle between 3° and 90° (depending on the target diameter and spacing of the nozzles) with a plane defined by the axis of the energy beam and a mean target path. In this connection, nozzles of the same size can be arranged at a shared nozzle chamber or at separate nozzle chambers.

In a second preferred embodiment, a pulse of the energy beam in the interaction chamber is synchronized with the ejection of a plurality of individual targets following one another in close succession from every nozzle of the injection device, wherein at least a first individual target from each nozzle is a sacrifice target for generating a vapor screen for at least one main target to be struck by the energy beam.

The changes in pressure in every nozzle chamber of the injection device are advantageously synchronized with the pulse of the energy beam in such a way that a target column comprising at least one sacrifice target and two main targets is prepared for every pulse of the energy beam from every nozzle. The nozzle chambers of the injection device for the ejection of targets can have an in-phase synchronization or an alternating phase-delayed synchronization of the means for temporarily increasing pressure. The latter variant has the added advantage that the individual targets move to the interaction point (e.g., the laser focus) so as to be offset relative to one another and results in a kind of "target curtain" when the nozzles are correspondingly arranged in a plurality of rows close together.

Further, in a method for metering target material for the generation of short-wavelength electromagnetic radiation, in particular EUV radiation, in which target material is provided from a nozzle of a target generator along a given target path and an energy beam for generating a radiation-emitting plasma is directed to the target path, the above-stated object is met by the following steps:

- generation of a quasistatic equilibrium pressure at the nozzle so that no target material exits from the nozzle in the inoperative state of the target generator;
- generation of a temporary pulsed pressure increase in a nozzle chamber located fluidically upstream of the nozzle, so that target material is shot out of the nozzle chamber through the nozzle and is accelerated as an individual target in direction of an interaction point with the energy beam; and
- synchronization of the pulsed pressure increase in the nozzle chamber with a pulse of the energy beam so that every individual target is struck precisely by a pulse of the energy beam.

Accordingly, the invention is based on the fundamental consideration that only precisely as much target material as is needed for efficient generation of short-wavelength electromagnetic radiation in the desired wavelength range may reach the interaction point because any excess amount of target material, even if only located in the area surrounding the interaction point, leads to the generation of unwanted target gas and additional debris. Also, it must be prevented that any target material at all passes the interaction point between the pulses of the energy beam in order to minimize the gas burden from vaporized or sublimated target material in the evacuated interaction chamber and to minimize the consumption of target material.

For this purpose, an injection device operating in a pulsed manner is used, according to the invention, for dispensing the individual targets in metered amounts, which injection device provides individual targets only when required, i.e., on demand (through pulse control), by means of an adjusted equilibrium pressure at the nozzle opening during pauses between injections.

The arrangement according to the invention makes it possible to introduce target material into the interaction chamber in the exact amount needed for efficient radiation generation at a desired repetition rate of the energy beam and to minimize debris generation and radiation absorption through vaporized target material in the interaction chamber. Further, the consumption of target material is reduced so that costs are appreciably lowered. Further, it is possible to increase the pulse repetition frequency.

In the following, the invention will be described more fully with reference to embodiment examples.

DESCRIPTION OF THE PREFERRED EMBODIMENTS

Figure 1:
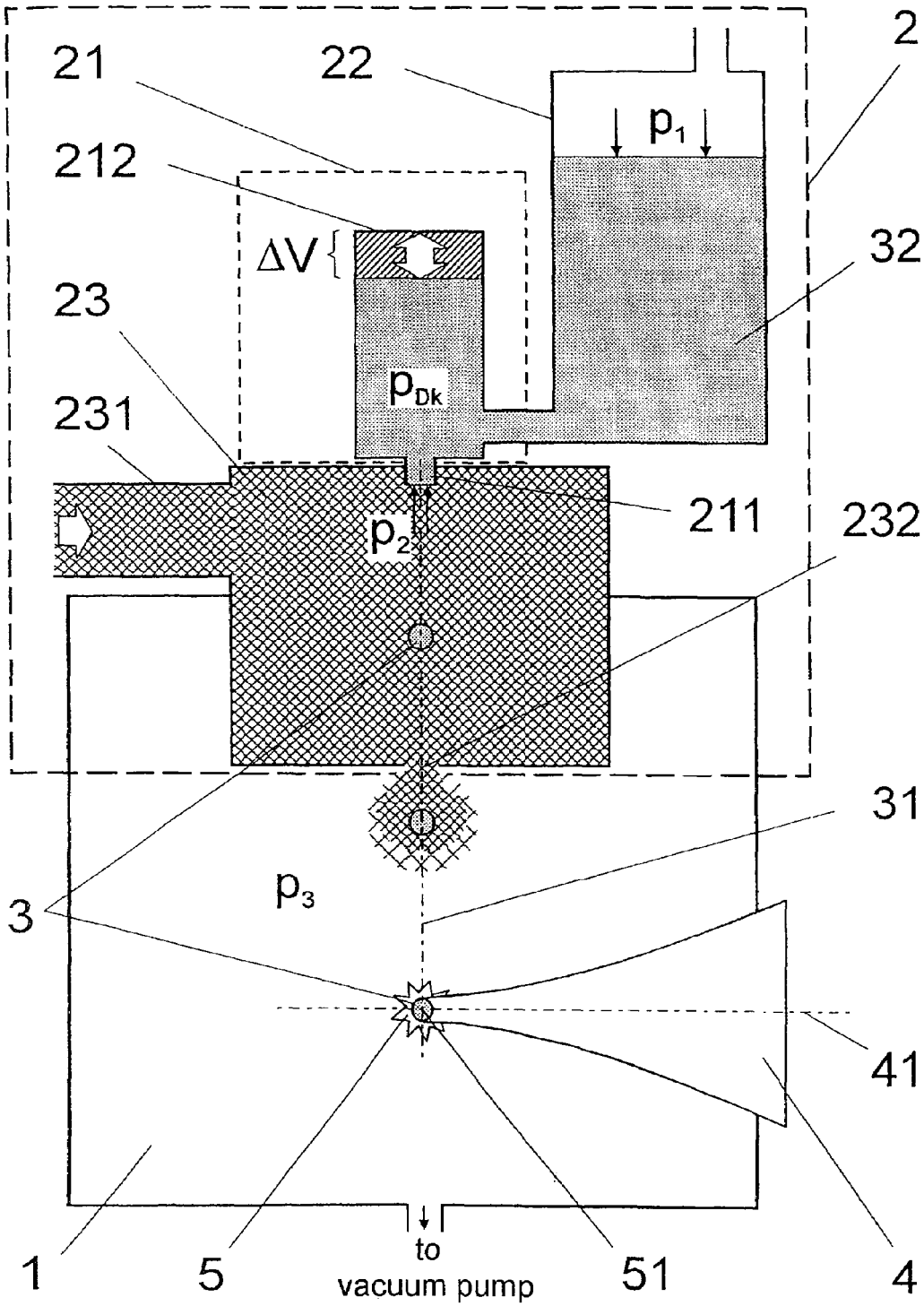
FIG. 1 shows a schematic view of the arrangement according to the invention.

FIG. 1 is a schematic view showing a portion of a radiation source for generating short-wavelength electromagnetic radiation based on a plasma induced by the input of energy. The drawing shows an interaction chamber 1 in which individual targets 3 are prepared along a target path 31 by a target generator 2. The target path 31 is intersected by the axis 41 of an energy beam 4 at an interaction point 51, wherein a plasma 5 emitting the desired radiation is generated by the energy beam 4 impinging on a respective individual target 3.

The target generator 2 comprises an injection device 21 with a nozzle 211 and a nozzle chamber 212 which is able to cause a temporary change in volume $\Delta V$ and, therefore, a change in pressure of the nozzle chamber pressure $P_{Dk}$. The principle is similar to that of conventional inkjet nozzles and will be described in more detail (FIG. 3 and FIG. 4) in the following. Further, the injection device 21 of the nozzle chamber 212 is connected to a reservoir 22 for the target material 32 which is maintained in liquid state at a defined process temperature with a suitable pressure $p_1$.

The nozzle 211 opens into an antechamber 23 in which an antechamber pressure $p_2$ is maintained. The antechamber 23 has at least one gas feed 231 that supplies an additional gas for adjusting a uniform (quasistatic) pressure around the nozzle 211. Further, the antechamber 23 has, along the target path 31, an opening 232 for the individual targets 3 that are shot in a pulsing manner from the nozzle 211 for passing into the interaction chamber 1. The opening 232 presents a defined flow resistance for the gas that is fed into the antechamber 23. Depending on the amount of gas supplied to the antechamber 23, the antechamber pressure $p_2$ can be adjusted approximately statically, i.e., there is a stationary gas flow. The supply of gas is regulated by the gas feed 231 in such a way that an equilibrium pressure is adjusted on the liquid target material 32 at the nozzle 211 so that no target material 32 can exit without a change in pressure in the nozzle chamber 211. An individual target 3, i.e., a defined amount of target material 32, is not shot out of the nozzle 211 until there is a temporary change in pressure in the nozzle chamber 212 (represented by volume change $\Delta V$). The individual target 3 flies through the antechamber 23, passes through the opening 232 of the latter into the interaction chamber 1 and is available as a mass-limited individual target 3 for generation of the plasma 5.

The gas which is fed into the antechamber 23 and which likewise reaches the interaction chamber 1 through the opening 232 is pumped out in the interaction chamber 1. One or more vacuum pumps (not shown) that are connected to the interaction chamber 1 are dimensioned in such a way that a vacuum pressure $p_3$ is maintained at which the desired radiation is absorbed as little as possible (<100 Pa).

Further, the gas supplied to the antechamber 23 can serve in addition as a moderator (buffer gas/moderator) for high kinetic energy particles (debris) from the plasma 5 which are decelerated and absorbed by the buffer gas so as to prolong the service life of the optical and mechanical components, particularly the collector mirror (not shown) for the radiation emitted from the plasma 5, and the nozzle 211.

Figure 2:
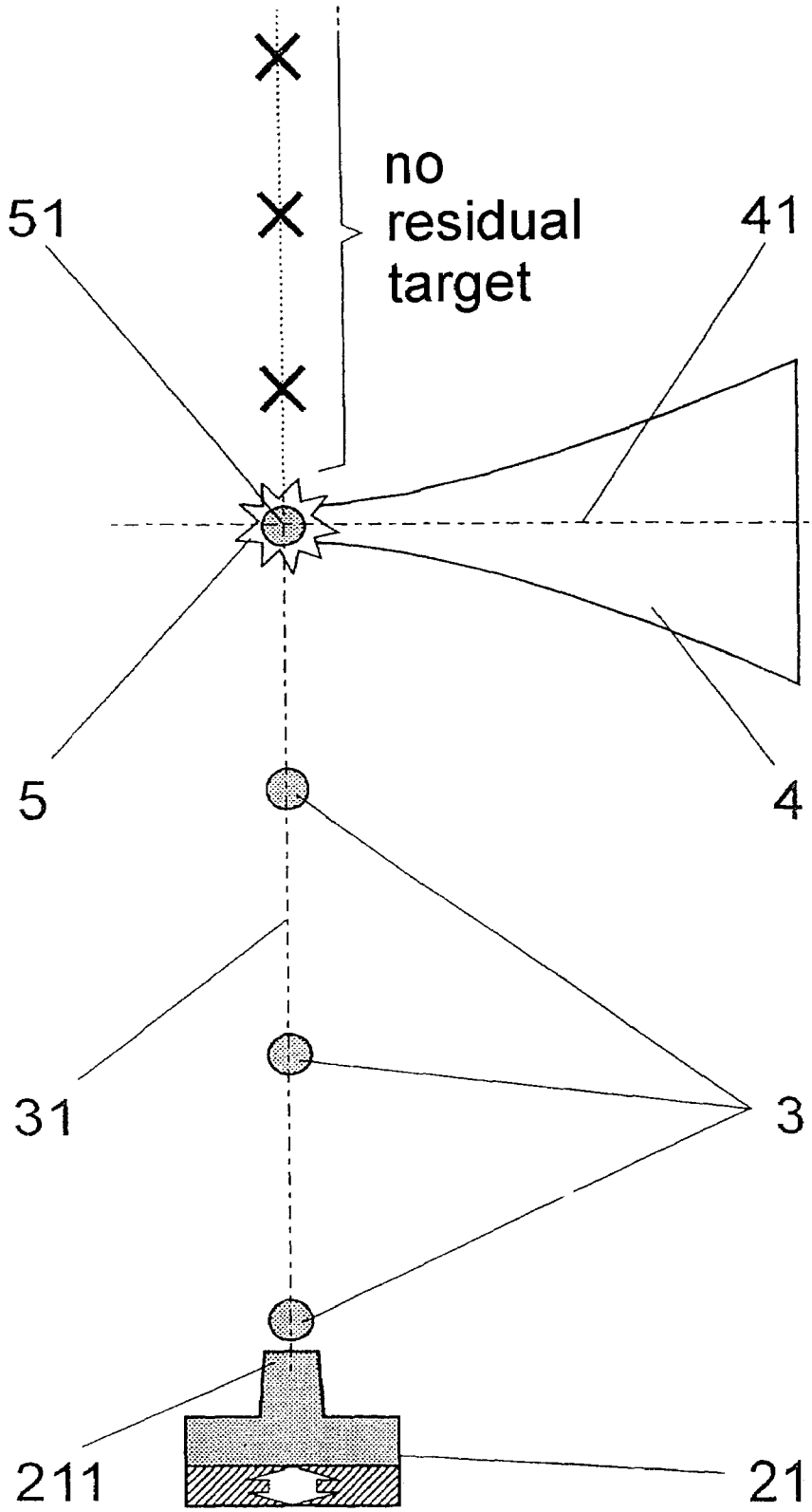
FIG. 2 is a schematic illustrating the method according to the invention.

FIG. 2 schematically illustrates the method according to the invention, wherein an individual target 3 is generated from the nozzle 211 only when this individual target 3 can also be converted (at a later time) by the energy beam into radiating plasma 5 at the interaction point 51. This means that individual targets 3 are generated only on demand. Since only liquid target material 32 can exit through the nozzle 211, this is referred to as Drop On Demand. Accordingly, corresponding to the desired pulse frequency of the energy beam 4, individual targets 3 are generated which arrive at the interaction point 51 with a period of the pulse frequency of the energy beam 4. Therefore, there are no individual targets 3 or other excess residual target components that continue along the target path 32 beyond the interaction point 51.

A possibility for metering very small volumes (up to the picoliter range) at frequencies of several kilohertz based on the so-called drop-on-demand method for nozzles of inkjet printers is described in the following with reference to FIG. 3 (piezo principle) and FIG. 4 (bubble jet principle).

All embodiment forms for realizing the drop-on-demand method have the same fundamental functional features with limited liquid ejection which are generalized, according to the invention, as follows. Upstream of the nozzle 211 there is a nozzle chamber 212 that is completely filled with a liquid (target material 32). By reducing the volume of the nozzle chamber 212, a defined amount of target material 32 corresponding approximately to the amount of the change in volume ΔV of the nozzle chamber 212 is ejected through the nozzle 211 and accordingly generates a mass-limited individual target 3.

The difference between the various embodiments of the drop-on-demand method employed by the invention consists only in the specific technique for achieving the volume reduction of the nozzle chamber 212 and temporary pressure increase at the nozzle 211. However, the specific way in which the volume change ΔV is carried out is not essential to the functioning of the principle of generation of mass-limited individual targets 3 according to the invention, so that any other principles (techniques) for temporary defined changes in pressure in the nozzle chamber 212 are also comprehended by the teaching of the invention.

Common to all methods of this type is that the static pressure on the reserved liquid and the pressure $p_2$ at the nozzle 211 are virtually equal in the inoperative state, i.e., when no individual target 3 (liquid droplet) is to be generated. The liquid target material 32 can be prevented from exiting through capillary forces with small pressure differences.

Two boundary conditions must be taken into account for metering small volumes of target material 32 in individual targets 3 for the generation of energy beam induced plasmas 5 that emit their radiation in the extreme ultraviolet spectral range. First, the target material 32 must be under vacuum for the excitation by the energy beam 4 in the interaction chamber 1, wherein—in order to prevent or minimize reabsorption of the desired radiation—the pressure $p_3$ (FIG. 1 and FIG. 8) in the interaction chamber 1 is typically less than 100 Pa (1 mbar). Second, the liquid pressure $p_{Dk}$ in the case of xenon (as preferred target material) must be at least approximately 80 kPa (0.8 bar) so that xenon is in a liquid state of aggregation, as can be seen from the phase diagram in FIG. 5.

If the outlet of the nozzle 211 were located directly in the interaction chamber 1 (see FIG. 1), the (large) pressure gradient in the nozzle 211 would necessarily lead to the continuous outflow of the liquid target material 32 into the vacuum of the interaction chamber 1, wherein one of the known target forms, i.e., jet target (continuous target flow according to EP 0 895 706 B1), discontinuous droplet flow (regularly exiting droplets according to EP 0 186 491 B1), dense droplet mist (from gas puff according to WO 01/30122 A1, or spray according to U.S. Pat. No. 6,324,256 B1) would occur, depending on the nozzle shape, liquid pressure and liquid temperature.

Figure 3:
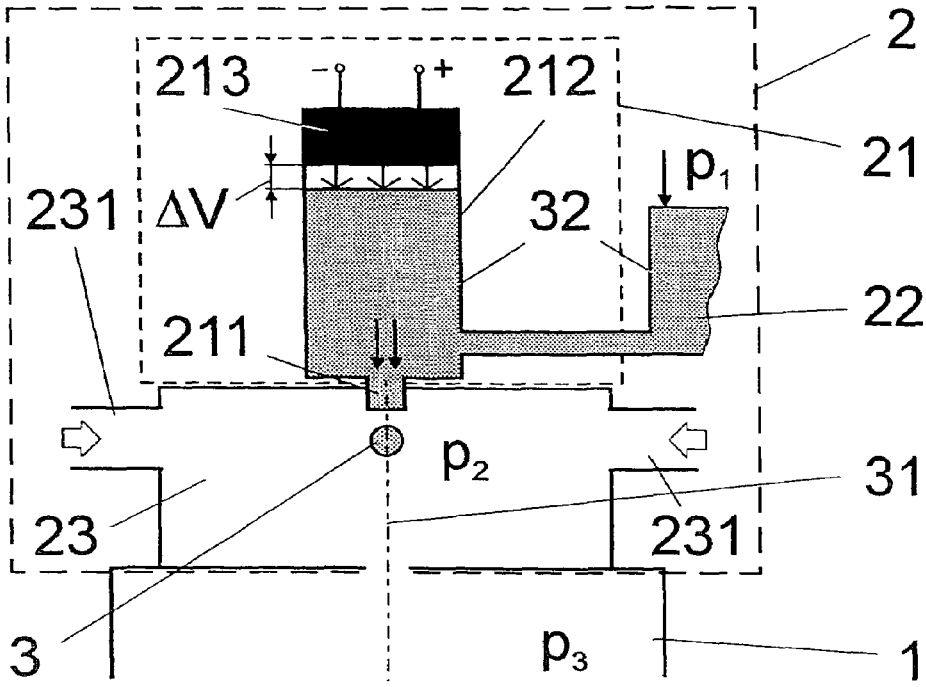
FIG. 3 shows a variant of the injection device with piezo element.
Figure 7A:
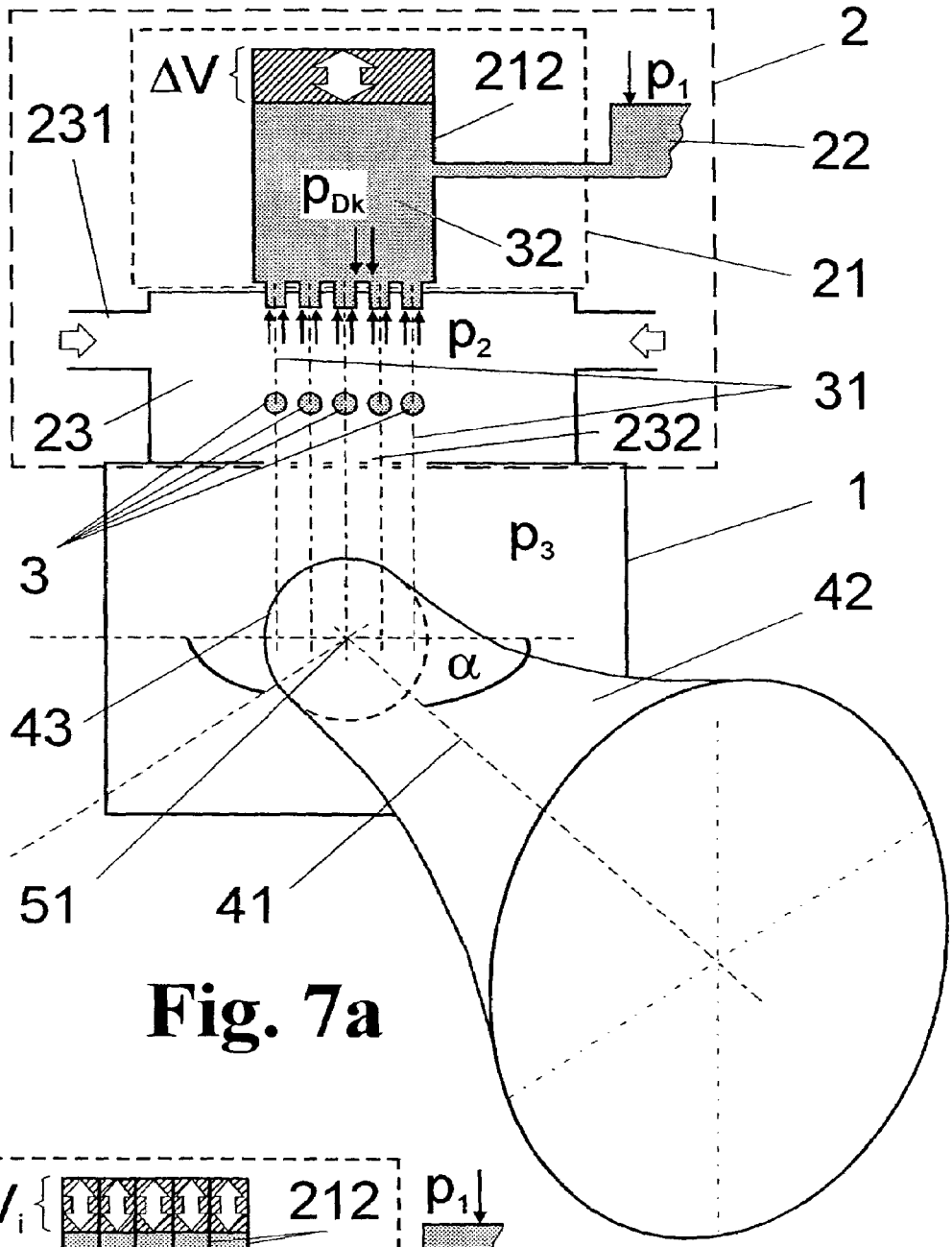
FIG. 7 shows two constructions of the injection device for generating target fields a) with a plurality of nozzles at a nozzle chamber and b) with one nozzle at each separate nozzle chamber.

The injection device 21 based on the piezo effect is shown schematically in FIG. 3. A piezo element 213, whose dimensions and volume increase when voltage is applied to it and which accordingly temporarily reduces the chamber volume by means of a change in volume ΔV of the nozzle chamber 212, is located in the nozzle chamber 212 or at a membrane forming a wall of the nozzle chamber 212. At the same time, the pressure in the nozzle chamber 212 increases above the equilibrium pressure $p_2$ in the antechamber 23. Therefore, when a voltage pulse is applied to the piezo element 213 a drop of liquid target material 32 is shot from the nozzle 211 into the antechamber 23. This process leads to the generation of individual targets 3 capable of synchronization with the desired or given pulse frequency of the energy beam 4 which can advantageously be a laser beam 42 (FIG. 7*a*).

Figure 4:
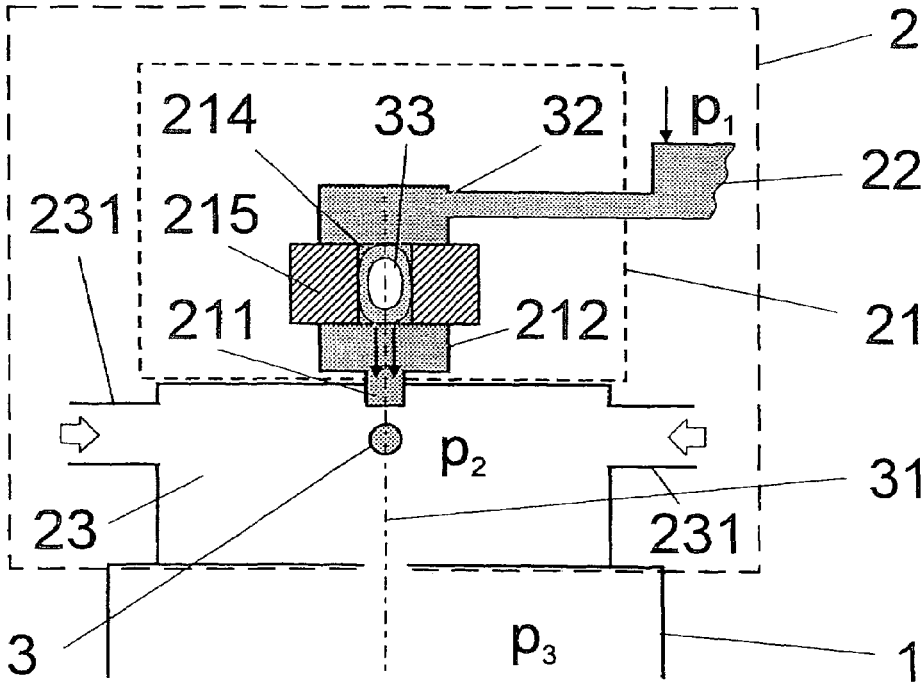
FIG. 4 shows a variant of the injection device with heating element.

FIG. 4 shows the schematic of an embodiment form of the injection device 21 based on the so-called bubble jet principle which is likewise known, per se, from inkjet printing technology. In this embodiment, a heating element 215 is arranged around a (preferably cylindrical) constriction 214 of the nozzle chamber 212. When a defined amount of target material 32 is to be dispensed through the nozzle 211, the heating element 215 is intensively heated temporarily. The constriction 214 for the heating element 215 can also be a segment of the connection line leading to the reservoir 22 so that the nozzle chamber 212 can be kept small and compact.

Due to the pulsed heating of the heating element 215, the liquid target material 32 vaporizes locally in the constriction 214 so that a vapor bubble 33 is formed. This vapor bubble 33 causes an increase in the volume of the target material 32 at a constant volume of the nozzle chamber 212 and, as a result of the pressure increase which therefore occurs in the nozzle chamber 212, presses an amount of liquid target material 32 out of the nozzle 211 in an explosive manner. The vapor bubble 33 collapses as a result of the ejection and subsequent cooling of the liquid, and target material 32 flows out of the reservoir 22.

Figure 5:
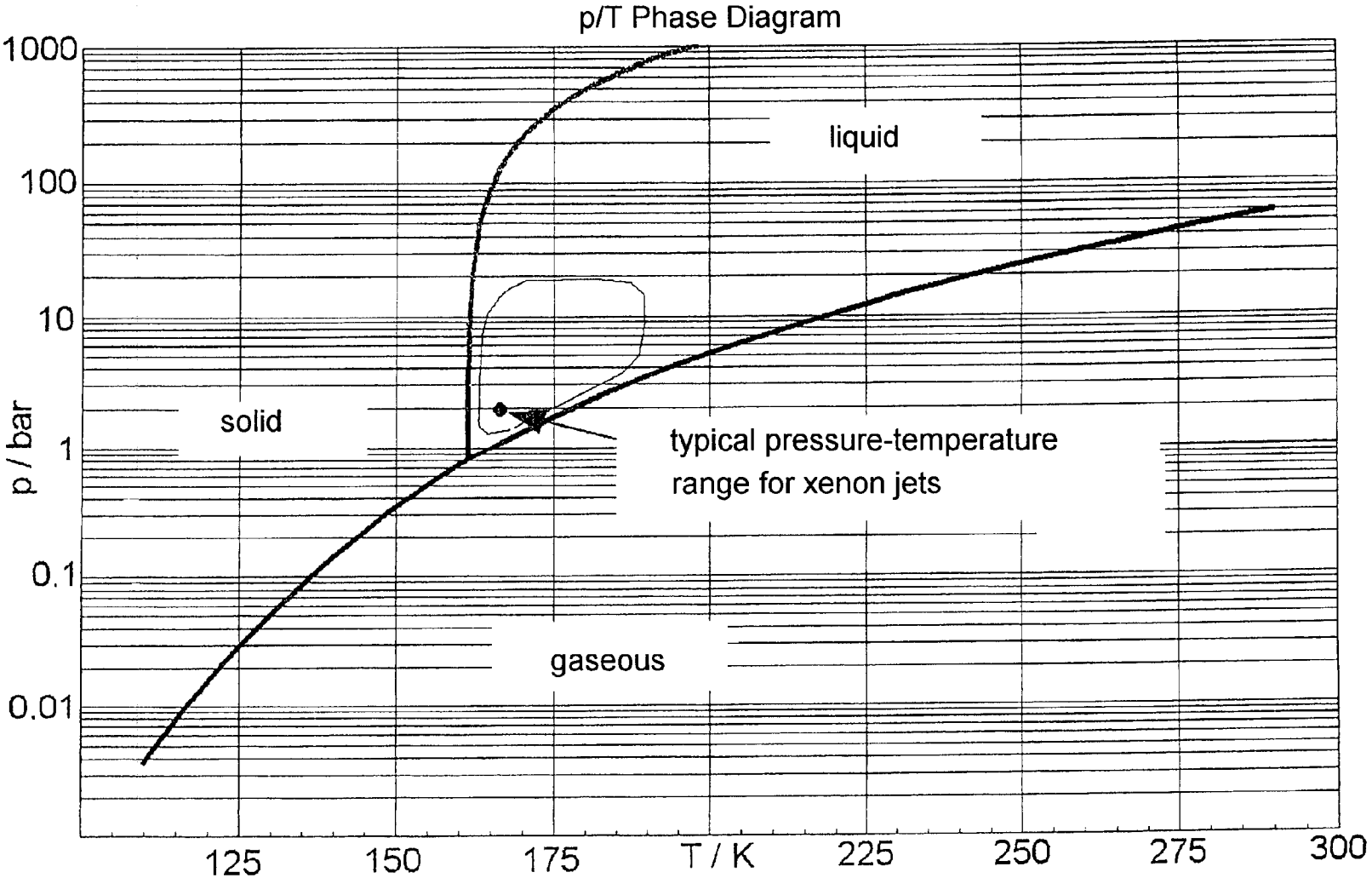
FIG. 5 is a schematic phase diagram for xenon.

FIG. 5 shows the phase diagram of xenon, which is a preferred target material 32. The diagram shows the typical temperature-pressure range for a xenon jet which detaches, possibly actively or passively, in droplets. This range occurs at temperatures between approximately 163 K (−111° C.) and 184 K (−90° C.) and at a pressure of about 0.1 MPa (1 bar) to 2 MPa (20 bar). Below a pressure of 80 kPa (0.8 bar), xenon is no longer liquid at any temperature. Therefore, it is necessary to charge a reservoir 22 with liquid xenon at a pressure $p_1$ of at least 0.8 bar. Xenon is advantageously liquefied at a temperature of 165 K under a pressure of 200 kPa in the reservoir. Approximately the same pressure is adjusted as antechamber pressure $p_2$ in a quasistatic (i.e., fluidically stationary) manner in the antechamber 23 by means of the gas feed 232 (according to the view in FIG. 1).

With other target materials 32, e.g., water or aqueous solutions of preferred characteristic EUV radiators (for example, tin alloys, tin(II) chloride $SnCl_2$ or tin(IV) chloride $SnCl_4$), as well as for aqueous or alcoholic solutions thereof, the phase diagram in FIG. 4 is very similar qualitatively, but the pressure-temperature range lies at appreciably different values. A target generator 2 that is somewhat modified in that the gravitational pressure of the liquid column in the reservoir 22 is used for reducing the equilibrium pressure at the nozzle 211 can be used with this group of target materials 32, as will be described below with reference to FIG. 8 and FIG. 9.

An exactly timed, metered injection of target material 32 (e.g., according to FIG. 1) is achieved in that the nozzle 211 opens into an antechamber 23 having increased pressure relative to the interaction chamber 1, so that in the passive state of the injection device 21 an equilibrium exists between the liquid pressure $p_{Dk}$ in the nozzle chamber 212 and a quasistatic pressure $p_2$ in the antechamber 23 through which gas flows. Target material 32 is shot out as a mass-limited individual target 3 only by means of a temporary pressure increase in the nozzle chamber 212 (according to the so-called drop-on-demand method), wherein the individual target 3 passes through the antechamber 23 virtually unchanged because of the increased pressure (at least the vapor pressure of the target material) and begins to vaporize only after exiting through an opening 232 in the vacuum of the interaction chamber 1.

The pressure $p_2$ in the antechamber 23, which has an opening for the passage of the individual target 3 along its predetermined target path 31, is adjusted in that gas flows in via comparatively large feed lines 231 and escapes into the interaction chamber 1 through the opening 232 which must be somewhat larger than the individual target 3 itself. The opening 232 constitutes flow resistance for the supplied gas. Therefore, the pressure at the gas feeds 231 is regulated in such a way that a quasistatic pressure $p_2$ almost identical to pressure $p_1$ (FIG. 1) is adjusted in the antechamber 23 and acts on the reserved liquid in the reservoir 22. The inactive condition and the thermodynamic condition for a target material 32 (e.g., xenon) that is liquefied (gaseous under normal pressure) in the reservoir 22 are accordingly met.

When it is required to dispense an individual target 3, the pressure of the liquid $p_{Dk}$ (FIG. 1) is temporarily increased above the pressure $p_2$ of the antechamber 23 in the injection device 21 for changing the volume ΔV in the nozzle chamber 212. A certain amount of target material 32 is accordingly pressed out of the nozzle 211 and accelerated.

The individual target 3 that is formed in this way flies through the antechamber 23 which is at pressure $p_2$ and enters the interaction chamber 1 through its opening 232, wherein a plasma 5 is generated by the introduction of energy (e.g., a laser pulse) in the individual target 3 arriving at the interaction point 51. Vacuum pumps (not shown) at the interaction chamber 1 are designed in such a way that a correspondingly low vacuum pressure $p_3$ (<100 Pa) is adjusted.

When the individual target 3 has entered the interaction chamber 1, a vaporization and sublimation process takes place—in a particularly intensive manner in the case of xenon—at the target surface, which reduces and cools the injected target material 32. This cooling is accompanied by a phase conversion, depending on the target volume and length of the target path 31, so that an individual target 3 of liquid target material 32 can also be frozen at the interaction point 51 (solid state of aggregation).

In addition to the amount of target material 32 for an individual target 3 which interacts directly with the energy beam 4 at the interaction point 51, an additional amount of target material 32 must be introduced for an efficient generation of radiation because of the vaporization and sublimation of the target material. This additional amount of target material 32 is vaporized and sublimated in the interaction chamber 1 along its target path 31 from the opening 232 of the antechamber 23 to the interaction point 51. This latter process is reinforced by the radiation from the plasma 5 that is absorbed by the target material 32 when a close succession of individual targets 3 is required because of high pulse repetition frequency of the energy beam 4.

Figure 6:
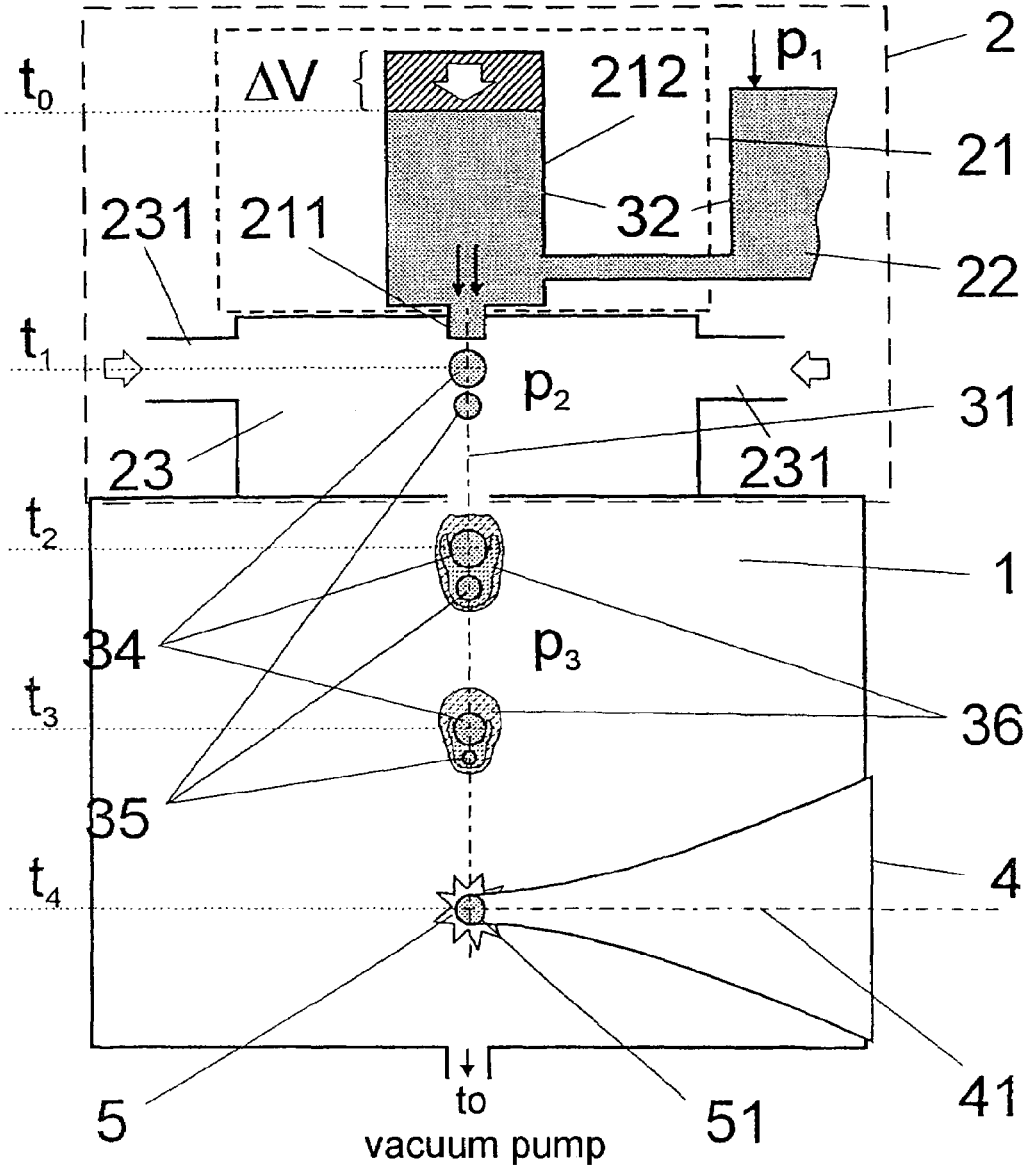
FIG. 6 illustrates an advantageous synchronization of individual targets as columns of sacrifice targets and main targets.

Therefore, it is useful to shoot a column of (at least) two liquid drops out of the nozzle 211 at a very short interval as is illustrated in FIG. 6, wherein the first drop(s) is (are) sacrifice targets 34 and the last drop is the main target 35 (remaining individual target 3 for the interaction with the energy beam 4).

In this connection, FIG. 6 shows, after a volume change ΔV (time $t_0$), a column of initially two targets 34 and 35 in the time segment from $t_1$ to $t_4$, of which only the main target 35 is left at the interaction point 51 because the sacrifice target 34 is vaporized or sublimated along the target path 31. The advantage of this procedure for generation of the final individual target 3 (main target 35) at the interaction point 51 is that metering is simpler because the main target 35 traverses the interaction chamber 1 behind the vaporization screen 36 of the sacrifice target(s) 34 virtually without loss of mass.

In order to reduce the evaporation or sublimation of target material 32 from the individual targets 3 shot from the nozzle 211, the gas flowing out into the antechamber 23 and interaction chamber 1 is selected in such a way that it acts, in addition, as a moderator for high kinetic energy particles from the plasma 5 (also called buffer gas). For this purpose, a gas is used which, on one hand, has the lowest possible absorption for the desired wavelength of the radiation from the plasma 5 and which, on the other hand, by pulsing, provides for good energy transmission and energy distribution of the high-energy atoms and ions (debris) emitted from the plasma 5. Gases of this kind are, e.g., inert gases such as nitrogen or most noble gases with a low atomic number such as helium, neon, argon or krypton. Argon (possibly mixed with helium in order to improve the flow behavior) is preferably used.

The radiation conversion from the plasma 5 is more efficient when the individual target 3 has a smaller depth than the energy beam 4, i.e., the target diameter is small. This is conflicts with the fact that, e.g., a laser beam 42 (as preferred realization of the energy beam 4, e.g., FIG. 6*a*) cannot be focused as small as desired and the efficiency of the radiation generation could therefore be increased by means of a "flat" target. A solution which approaches this ideal and which can actually be realized consists in one or more rows of droplets as is shown in FIGS. 6*a* and 6*b*.

For this purpose, as is shown in FIG. 7*a*, a plurality of nozzles 211 are arranged closely adjacent to one another in a nozzle chamber 212, each of which ejects an individual target 3 simultaneously. These individual targets 3 which are lined up in one or more straight lines (FIG. 7*b*) arrive at the focus 43 of the laser beam 42 after a defined time of flight along the separate target paths 31 and are illuminated simultaneously during a laser pulse and converted into radiating plasma 5.

Figure 7B:
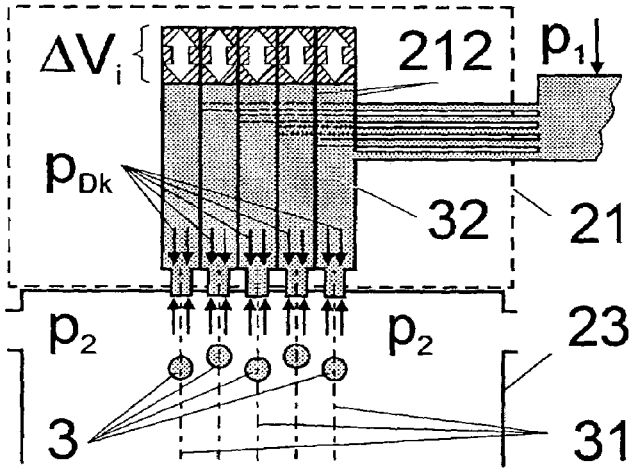

FIG. 7*b* builds upon the same principle as FIG. 7*a*, but in this case each nozzle 211 is associated with a separate nozzle chamber 212. The separate volume changes ΔV in the individual nozzle chambers 212 can preferably be carried out by separate piezo elements (not shown) synchronously or—as is shown in FIG. 7*b*—with a time offset.

According to FIG. 7*a*, the nozzles 211 are arranged along a straight line which has an angle α, clearly diverging from 90°, with the optical axis 41 of the laser beam 42. Alternatively, the nozzles 211 can also be arranged so as to be offset relative to one another in a plurality of rows (according to DE 103 06 668 A1) in order to increase the density of the individual targets 3 (e.g., without substantial gaps or overlapping).

Further, the "flat" target according to FIG. 7*a* or 7*b* can be combined with the droplet column according to FIG. 5, wherein a plurality of main targets 35 follow the sacrifice targets 34 that are included for vaporization, so that there occurs in all almost a "carpet" of droplets which is struck by a pulse of the laser beam 42. In combination with the above-mentioned plurality of rows of nozzles (not shown), the intervals between the individual targets 3 arriving in the laser focus 43 can also be narrowed when the nozzles 211 of different rows have ejection times that are slightly delayed with respect to one another.

Figure 8:
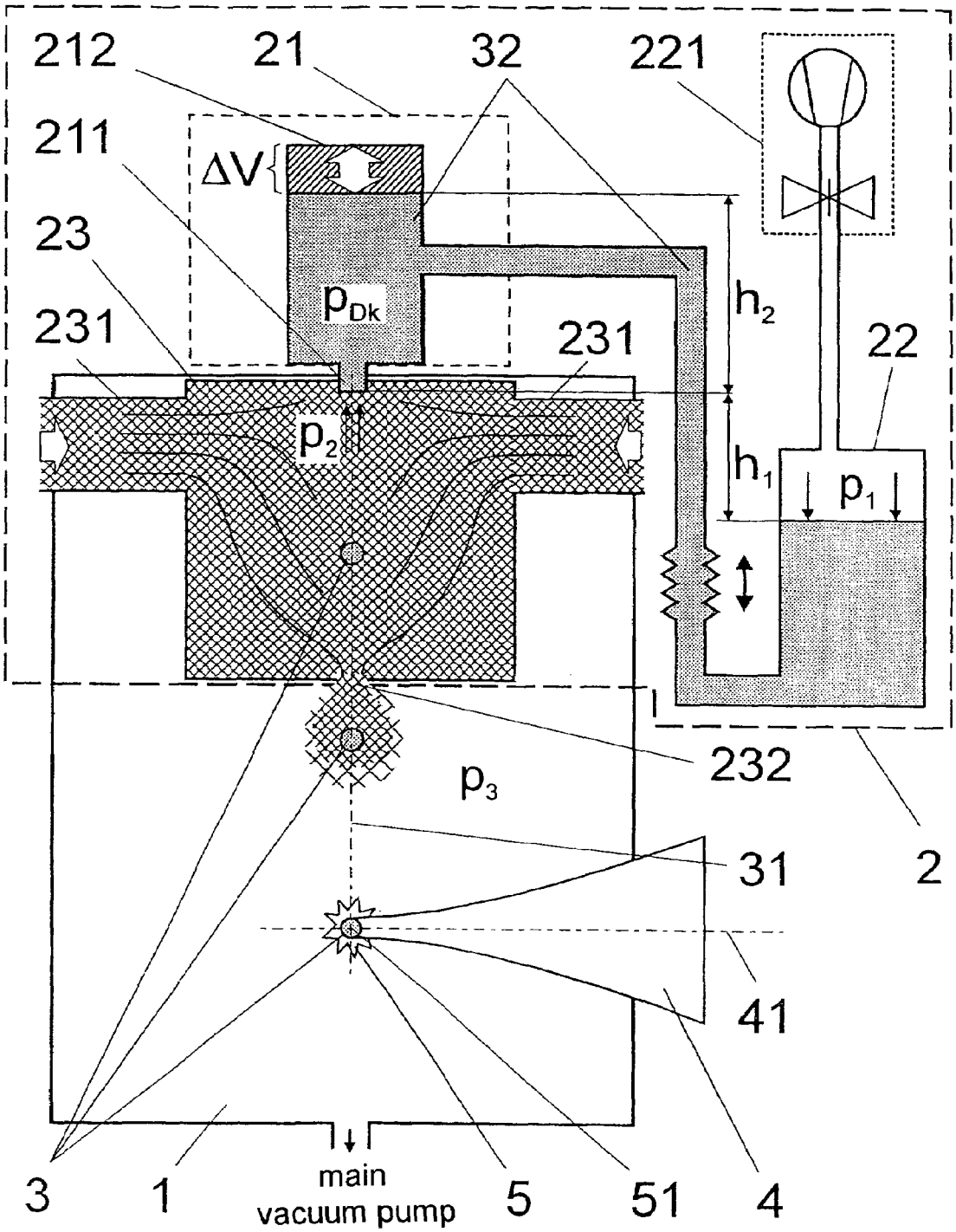
FIG. 8 shows a variant of the target generator with a special construction of the reservoir for reducing the equilibrium pressure at the nozzle for target materials with low vapor pressure (<50 mbar)

Another special construction of the invention for target materials 32 with low vapor pressure is shown in FIG. 8.

When the target material 32 is a liquid having a low vapor pressure (<50 mbar) under process conditions, e.g., tin(IV) chloride ($SnCl_4$ has a vapor pressure of about 25 mbar at room temperature), or tin(II) chloride ($SnCl_2$ has a vapor pressure of about 24 mbar in aqueous or alcoholic solution at room temperature), or simply water ($H_2O$ vapor pressure approximately 25 mbar), the gas pressure in the antechamber 23 can be minimized and the gas burden in the interaction chamber 1 can accordingly be reduced. For this purpose, as is shown in FIG. 8, the pressure of the target material 32 in the nozzle chamber 212 is reduced in that the gas pressure $p_1$ in the reservoir 22 is suitably adjusted by evacuating the gas volume over the target material 32 by means of a vacuum pump 221 outfitted with a regulating valve.

In addition or alternatively, the liquid pressure $p_{Dk}$ at the nozzle 211 can be adjusted by a height difference $h_1$ between the levels of the target material 32 in the reservoir 22 and in the nozzle 211 to $$p_{Hd}=\rho\cdot g\cdot h_1,$$

where ρ is the density of the target material 32 and g is the acceleration due to gravity. The pressure $p_2$ in the antechamber need then—at the minimum, when $p_1$ corresponds to the vapor pressure of the target material 32—compensate only the gravitational pressure $$p_{Sd}=\rho\cdot g\cdot h_2$$

of the target material 32 along the nozzle 211 in the nozzle chamber 212 in addition in order to prevent target material 32 from flowing out of the nozzle 211 in the passive state of the injection device 21.

Figure 9:
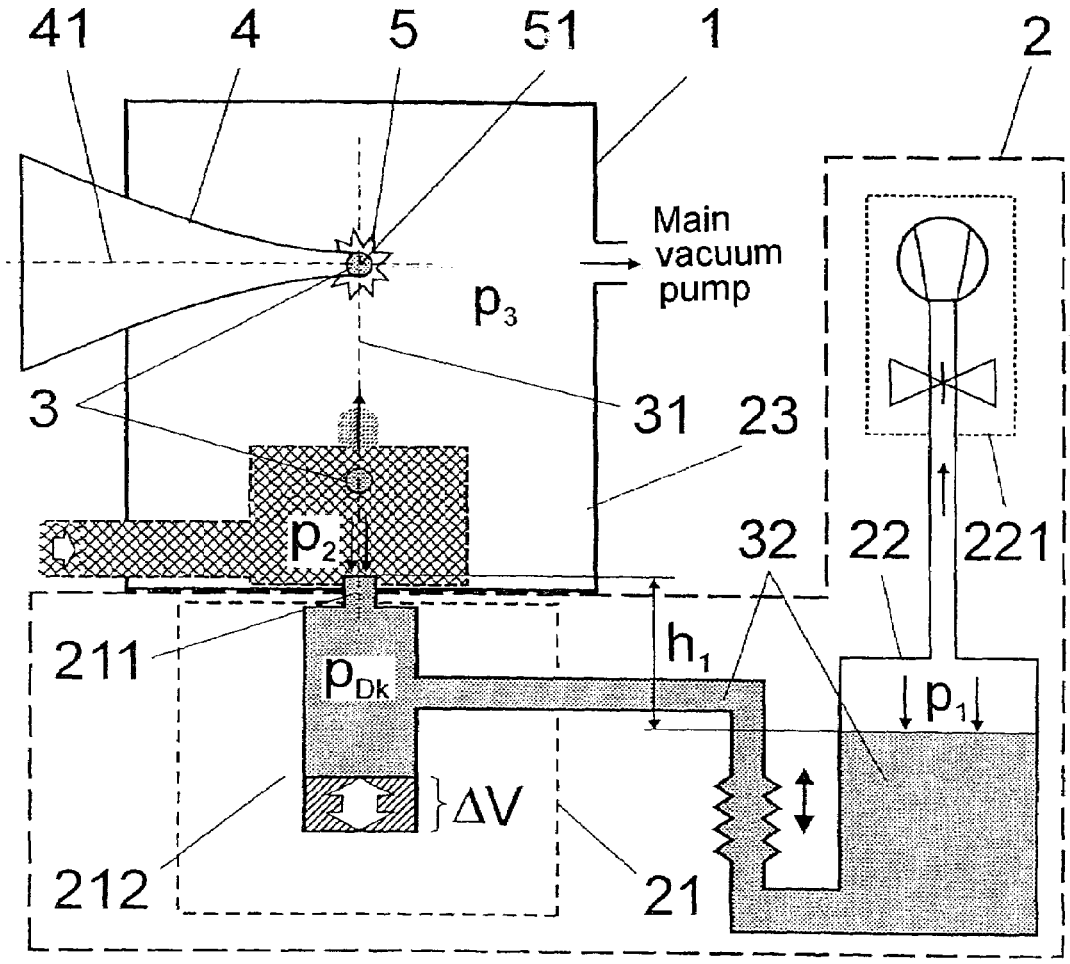
FIG. 9 shows a special variant of the target generator for target materials with low vapor pressure (<50 mbar) in which the equilibrium pressure at the nozzle can be adjusted by means of its ejection direction opposed to the force of gravity and to the gravitational pressure of the target material relative to the interaction chamber.

FIG. 9 shows another modification of the arrangement according to FIG. 8 for target materials 32 with low vapor pressure (<50 kPa) in which the ejection direction of the nozzle(s) 211 is oriented against the acceleration due to gravity. Accordingly, another reduction of the required equilibrium pressure $p_2$ at the nozzle 211 can be achieved.

If the gravitational pressure $$p_{Hd}=\rho\cdot g\cdot h_1$$

of the liquid column of the target material 32 can be successfully adjusted through the selection of target material 32 and of the (negative) height difference $h_1$ (between the outlet of the nozzle 211 and the liquid level in the reservoir 22) in such a way that the pressure difference between the pressure $p_1$ (at a minimum, the vapor pressure of the target material 32) in the reservoir 22 and the vacuum pressure $p_3$ (e.g., 100 Pa) in the interaction chamber 1 can be compensated, an antechamber 23 is not required in theory. For this reason, it is shown in dashes in FIG. 9.

However, in this configuration also, it has proven advisable to use an antechamber 23 in order, on the one hand, to avoid unnecessarily large lengths of the connection line between the reservoir 22 and the nozzle chamber 212 and, on the other hand, to decelerate highly kinetic particles (debris) from the plasma 5 and additionally stabilize the target path 31 of the individual targets 3.

The object in the embodiment variants according to FIG. 8 and FIG. 9, as in all of the variants of the invention, is to adjust the sum of all of the pressure components acting at the outlet of the nozzle 211 to zero in the inoperative state of the injection device 21, i.e., to compensate the pressure $p_1$ (at least the vapor pressure of the target material 32) which is substantially higher in the reservoir 22 than in the interaction chamber 1. However, aside from the antechamber arrangement that is primarily suggested for this purpose with dynamic pressure $p_2$ (as counter-pressure to the minimum adjusted vapor pressure of the target liquid) that is adjusted so as to be quasistatic (fluidically stationary), other equivalent means for pressure compensation clearly belong to the technical teaching of the invention, for example, the variants without an antechamber 23 which were described with reference to FIG. 9.

While the foregoing description and drawings represent the present invention, it will be obvious to those skilled in the art that various changes may be made therein without departing from the true spirit and scope of the present invention.

REFERENCE NUMBERS

1 vacuum chamber
2 target generator
21 injection device
211 nozzle
212 nozzle chamber
213 piezo element
214 constriction
215 heating element
22 reservoir
221 vacuum pump
23 antechamber
231 gas feed
232 opening
3 individual target
31 target path
32 target material
33 vapor bubble
34 sacrifice target
35 main target
36 vaporization screen
4 energy beam
41 axis
42 laser beam
43 focus
5 plasma
51 interaction point
$h_1$, $h_2$ height difference
$p_1$, $p_2$, $p_3$ pressure
$p_{Dk}$ liquid pressure (in the nozzle chamber)
ΔV volume change
α angle

What is claimed is:

1. An arrangement for metering target material for the generation of EUV radiation, comprising: a target generator being arranged for providing target material along a given target path; an energy beam for generating a radiation-emitting plasma being directed to the target path; said target generator having an injection device which contains a nozzle chamber with nozzle and which is connected with a reservoir; means being provided for a defined, temporary pressure increase in the nozzle chamber in order to introduce an individual target into the interaction chamber at the interaction point exclusively when required for the generation of plasma; and means being arranged in the nozzle for adjusting an equilibrium pressure in order to compensate for a pressure drop at the nozzle of the injection device resulting from the pressure difference between the vacuum pressure in the interaction chamber and the pressure exerted on the target material in the reservoir; wherein the adjusted equilibrium pressure prevents the escape of target material as long as there is no temporary pressure increase in the nozzle chamber.

2. The arrangement according to claim 1, wherein a piezo element is provided as means for increasing pressure in the nozzle chamber, wherein the piezo element displaces a wall of the nozzle chamber inward.

3. The arrangement according to claim 2, wherein the nozzle chamber has a membrane wall that is pressed inward when voltage is applied to the piezo element.

4. The arrangement according to claim 2,
wherein the piezo element is arranged inside the nozzle chamber for reducing the chamber volume.

5. The arrangement according to claim 1,
wherein a constriction is provided in the nozzle chamber, a heating element by which the target material is vaporized inside the constriction being arranged around the constriction, wherein target volume is displaced into the nozzle chamber by thermal expansion and leads to a temporary increase in pressure.

6. The arrangement according to claim 5,
wherein a portion of a connection line to the reservoir that lies close to the nozzle chamber is provided as a constriction of the nozzle chamber.

7. The arrangement according to claim 1,
wherein additional pressure is applied in the reservoir for liquefaction in case of a target material that is liquid at pressures above 50 mbar.

8. The arrangement according to claim 7,
wherein xenon is used as target material.

9. The arrangement according to claim 1,
wherein the gravitational pressure of the target material in the reservoir is provided for adjusting pressure in case of a target material that is liquid under process temperature at pressures below 50 mbar.

10. The device according to claim 9,
wherein target material using tin is used.

11. The device according to claim 10,
wherein a metal tin alloy is used as target material.

12. The device according to claim 10,
wherein tin(IV) chloride is used as target material.

13. The device according to claim 10,
wherein the target material is an aqueous solution of tin(II) chloride.

14. The device according to claim 10,
wherein the target material is an alcoholic solution of tin(II) chloride.

15. The arrangement according to claim 9,
wherein in the case of a target material which is liquid at pressures below 50 mbar under process conditions for plasma generation, the gravitational pressure of the target material is provided to minimize the equilibrium pressure at the outlet of the nozzle,
wherein, in order to reduce pressure, a height difference between the liquid level of the target material at the nozzle and in the reservoir is adjusted in such a way that the liquid level in the reservoir lies below the outlet of the nozzle in the direction of the force of gravity.

16. The arrangement according to claim 15,
wherein the nozzle is arranged in direction of the force of gravity.

17. The arrangement according to claim 15,
wherein the outlet direction of the nozzle is arranged opposite to the direction of the force of gravity.

18. The arrangement according to claim 1,
wherein an antechamber having an opening along the target path for the exit of the individual targets is arranged around the nozzle of the injection device upstream of the interaction chamber as a means for generating an equilibrium pressure, wherein a quasistatic pressure is present in the antechamber which, as equilibrium pressure, prevents target material from escaping as long as there is no temporary pressure increase in the nozzle chamber.

19. The arrangement according to claim 18,
wherein a buffer gas is used as gas supplied to the antechamber as a moderator for high kinetic energy particles from the plasma.

20. The arrangement according to claim 19,
wherein the gas supplied to the antechamber is an inert gas.

21. The arrangement according to claim 20,
wherein the gas supplied to the antechamber contains nitrogen.

22. The arrangement according to claim 20,
wherein the gas supplied to the antechamber contains at least one noble gas.

23. The arrangement according to claim 1,
wherein the energy beam is a focused laser beam.

24. The arrangement according to claim 1,
wherein a pulse of the energy beam in the interaction chamber is synchronized with the ejection of exactly one individual target.

25. The arrangement according to claim 1,
wherein a pulse of the energy beam in the interaction chamber is synchronized with the ejection of at least two individual targets from the nozzle of the injection device, wherein at least a first target is formed as a sacrifice target for generating a vapor screen for a main target to be struck by the energy beam.

26. The arrangement according to claim 1,
wherein a pulse of the energy beam in the interaction chamber is synchronized with the ejection of at least two individual targets from a plurality of nozzles of the injection device, wherein the nozzles are arranged in at least one plane that forms an angle between 3° and 90° with a plane defined by the axis of the energy beam and an average target path.

27. The arrangement according to claim 26,
wherein the nozzles are arranged at a shared nozzle chamber.

28. The arrangement according to claim 26,
wherein the nozzles are arranged at separate nozzle chambers.

29. The arrangement according to claim 26,
wherein a pulse of the energy beam in the interaction chamber is synchronized with the ejection of a plurality of individual targets following one another in close succession from every nozzle of the injection device, wherein at least a first individual target from each nozzle is a sacrifice target for generating a vapor screen for at least one main target to be struck by the energy beam.

30. The arrangement according to claim 28,
wherein the changes in pressure in every nozzle chamber of the injection device are synchronized with the pulse of the energy beam in such a way that a target column comprising at least one sacrifice target and two main targets is prepared for every pulse of the energy beam from every nozzle.

31. The arrangement according to claim 28,
wherein the nozzle chambers of the injection device for the ejection of targets have an in-phase synchronization of the means for temporarily increasing pressure.

32. The arrangement according to claim 28,
wherein adjacent nozzle chambers of the injection device have an alternating phase-delayed synchronization of the means for temporarily increasing pressure.

33. A method for metering target material for the generation of EUV radiation, in which target material is provided from a nozzle of a target generator along a given target path and an energy beam for generating a radiation-emitting plasma is directed to the target path, comprising the following steps:

generation of a quasistatic equilibrium pressure at the nozzle so that no target material exits from the nozzle in the inoperative state of the target generator;

generation of a temporary pulsed pressure increase in a nozzle chamber located fluidically upstream of the nozzle, so that target material is shot out of the nozzle chamber through the nozzle and is accelerated as an individual target in direction of an interaction point with the energy beam; and synchronizing the pulsed pressure increase in the nozzle chamber with a pulse of the energy beam so that every individual target is struck precisely by a pulse of the energy beam.

* * * * *